US010974937B2

(12) United States Patent
Roodenburg et al.

(10) Patent No.: US 10,974,937 B2
(45) Date of Patent: Apr. 13, 2021

(54) CRANE HOUSING FOR A CRANE AND CRANE COMPRISING SAID CRANE HOUSING

(71) Applicant: ITREC B.V., Schiedam (NL)

(72) Inventors: Joop Roodenburg, Schiedam (NL); Theodorus Cornelis Joanes Maria Stijnman, Schiedam (NL); Wing Sum Lee, Schiedam (NL)

(73) Assignee: ITREC B.V., Schiedam (NL)

( * ) Notice: Subject to any disclaimer, the term of this patent is extended or adjusted under 35 U.S.C. 154(b) by 70 days.

(21) Appl. No.: 16/483,364

(22) PCT Filed: Feb. 2, 2018

(86) PCT No.: PCT/NL2018/050073

§ 371 (c)(1),
(2) Date: Aug. 2, 2019

(87) PCT Pub. No.: WO2018/143807

PCT Pub. Date: Aug. 9, 2018

(65) Prior Publication Data

US 2020/0031636 A1 Jan. 30, 2020

(30) Foreign Application Priority Data

Feb. 3, 2017 (NL) ..... 2018300

(51) Int. Cl.
*B66C 23/62* (2006.01)
*B66C 23/52* (2006.01)
(Continued)

(52) U.S. Cl.
CPC ..... *B66C 23/62* (2013.01); *B66C 23/52* (2013.01); *B66C 23/82* (2013.01); *B66C 23/826* (2013.01);
(Continued)

(58) Field of Classification Search
CPC ..... B66C 23/52; B66C 23/62; B66C 23/82; B66C 23/84; B66C 2700/0321; B66C 2700/0392
See application file for complete search history.

(56) References Cited

FOREIGN PATENT DOCUMENTS

DE 2541065 A1 * 3/1977 ..... B66C 23/52
DE 3408866 A1 9/1985
(Continued)

OTHER PUBLICATIONS

International Search Report for PCT/NL2018/050073 (PCT/ISA/210) dated Jun. 6, 2018.
(Continued)

*Primary Examiner* — Michael R Mansen
*Assistant Examiner* — Juan J Campos, Jr.
(74) *Attorney, Agent, or Firm* — Birch, Stewart, Kolasch & Birch LLP

(57) ABSTRACT

A crane housing having a substantially cylinder-shaped circumferential wall with a lower section and lower end mounted to a slew bearing of substantially the same diameter includes a boom support structure to support an inner end of a pivotal boom arranged at a front side of the crane housing. The boom support structure includes at least two box elements of each of which an end portion overlaps with and is integrated with the upper section of the circumferential wall. Oblique strengthening ribs are mounted onto and integrated with a side of the circumferential wall and extend from a respective box element end portion in an oblique downwards direction towards the lower end of the wall.

18 Claims, 4 Drawing Sheets

(51) Int. Cl.
*B66C 23/82* (2006.01)
*B66C 23/84* (2006.01)

(52) U.S. Cl.
CPC ..... *B66C 23/84* (2013.01); *B66C 2700/0321* (2013.01); *B66C 2700/0392* (2013.01)

(56) References Cited

FOREIGN PATENT DOCUMENTS

| | | | |
|---|---|---|---|
| EP | 0 165 854 | A1 | 12/1985 |
| WO | WO 2015/088332 | A1 | 6/2015 |

OTHER PUBLICATIONS

Written Opinion of the International Searching Authority for PCT/NL2018/050073 (PCT/ISA/237) dated Jun. 6, 2018.

* cited by examiner

CRANE HOUSING FOR A CRANE AND CRANE COMPRISING SAID CRANE HOUSING

The invention relates to a crane housing for a crane and a crane comprising said crane housing.

The invention is primarily envisaged for a crane housing of a crane, and a crane comprising such a crane housing, wherein the crane is of the type comprising a fixed base structure, the crane housing, and a slew bearing in between the fixed base structure and crane housing to allow for slew motion of the crane housing relative to the fixed base structure. The crane housing is provided with a boom support structure that is adapted to support an inner end of a pivotal boom of the crane so that said boom is pivotal about a horizontal pivot axis. The boom support structure is arranged at a front side of the crane housing. This crane also has a gantry structure that is arranged on top of the crane housing and attached to the crane housing. One or more winch driven luffing cables extend between the gantry structure and the boom, commonly in a multiple fall arrangement with cable sheaves arranged at the top of the gantry structure and with cable sheaves near the outer end of the boom. The boom may be extended by a removable or permanent auxiliary jib.

WO2015/088332 discloses a crane of the type discussed above embodied as a heavy lift crane that is mounted on an offshore vessel, in said example a semi-submersible offshore vessel. In particular this document discloses the provision of a slew roller bearing between the lower end of the circumferential wall and the fixed base structure. The slew roller bearing is a roller bearing with raceways between which a multitude of rollers are arranged so as to transmit weight loads, tilting loads, and radial loads between the crane housing and the fixed base. In the context of the present invention it is preferred to have such a slew roller bearing. The crane housing has a cylindrical circumferential wall of a diameter substantially corresponding to the slew bearing. At the lower end of the circumferential wall a slew bearing flange is arranged onto which the slew bearing is mounted. In the context of the present invention it is preferred to have such a slew bearing flange, e.g. the flange protruding inward and/or outward from the circumferential wall as the slew bearing has a greater radial dimension than the thickness of the circumferential wall.

In known proposals, also envisaged in the context of the present invention, the slew bearing diameter may be more than 10 meter or more, e.g. 15 meter or more, e.g. about 30 meter.

Due to the industry requirements of such heavy lift cranes, also envisaged in the context of the present invention, to have a lifting capacity of more than 1.000 mt, e.g. over 3.000 mt, e.g. over 5.000 mt, e.g. about 10.000 mt at a radius of 48 meter, the forces applied to the crane housing via the boom and the gantry structure are enormous. These forces need to be transferred by the crane housing to the fixed base structure via the slew bearing. This is a challenging task, e.g. in view of load distribution with the crane housing and/or over the slew bearing.

It is therefore an object of the invention to provide an improved crane housing that is able to effectively transfer forces to the slew bearing.

To achieve this object, the invention provides a crane housing comprising:

a substantially cylinder-shaped circumferential wall with a lower section delimited by a lower end of the wall, which lower end is adapted to be mounted to a slew bearing, said lower end having a diameter corresponding substantially to the diameter of the slew bearing, and with an upper section delimited by an upper end of the wall, the wall having an inside and an outside, a boom support structure adapted to support an inner end of a pivotal boom of the crane to pivot about a horizontal pivot axis, which boom support structure is arranged at a front side of the crane housing, wherein the boom support structure comprises at least two box elements of each of which an end portion overlaps with and is integrated with the upper section of the wall, and wherein the crane housing further comprises oblique strengthening ribs that are mounted onto and integrated with a side of the circumferential wall, each of said oblique strengthening ribs extending from a respective box element end portion in an oblique downwards direction towards the lower end of the circumferential wall.

It will be appreciated that in practical embodiments the circumferential wall is made of steel and the boom support structure is made of steel, wherein the box elements end portions are preferably integrated with the wall by welding to allow the effective introduction of forces into the wall. Subsequently, the forces are distributed by the wall and by the strengthening ribs over the wall in order to be transferred to the slew bearing that is in assembled condition of the crane connected to the lower end of the wall, preferably to a slew bearing flange mounted at the lower end of the circumferential wall. This arrangement allows to keep the maximum local loads that are applied to the slew bearing relatively low.

As preferred the box elements may have over a major portion of their length a rectangular and substantially hollow cross-section that is formed by planar steel plates joined along their edges. Internal stiffeners may be provided in the box elements when required.

Another advantage is that vertical and horizontal loads are transferred directly from the upper end of the wall via the wall to the lower end of the wall to be absorbed by the slew bearing.

Using the crane housing according to the invention only requires a relatively stiff structure on one side of the slew bearing, preferably the crane housing side. As a result, the chance of peak loads occurring in the crane housing, slew bearing, or base structure is reduced with the crane housing according to the invention.

For example the fixed base structure is a crane tub, e.g. a cylindrical crane tub or a crane tub having a circular top end and a rectangular bottom end, that is welded onto the hull of an offshore crane vessel, e.g. onto the deck structure of a semi-submersible crane vessel.

Preferably the crane housing is at least partially closed at the lower end of the wall by a floor, e.g. the floor being embodied as a disc shaped steel structure that is circumferentially secured to the lower end of the circumferential wall so as to provide stiffness in a radial plane to said lower end.

Preferably the crane housing is at least partially closed at the upper end of the wall by a roof. The roof is preferably embodied as a disc shaped steel structure, e.g. parallel to the floor or at an incline, which disc shaped steel structure is circumferentially secured to the upper end of the circumferential wall so as to provide stiffness to said upper end.

As preferred the crane housing has a floor and a roof, each embodied as a disc shaped steel structure that is circumferentially secured to the lower and upper end of the circumferential wall respectively.

In an embodiment, the crane housing is at least partially closed at the lower end of the wall by a floor and/or the crane housing is at least partially closed at the upper end of the wall by a roof. The large loads applied to the crane housing will tend to deform the cylinder-shaped circumferential wall. By closing the crane housing on one side, preferably on both sides, additional stiffness is introduced to keep the lower end and/or upper end in a circular shape. As described before, in case the crane housing is relatively stiff in horizontal direction, the base structure on the other side of the slew bearing can be designed less stiff in horizontal direction to reduce peak loads in the crane.

Another advantage of providing a floor and/or roof is that equipment, e.g. winches and/or electrical equipment, can be placed inside the crane housing.

In an embodiment, the roof comprises a beam extending from one of the box elements to another one of the box elements. Preferably, this beam extends in a transverse direction.

In case the crane housing is not provided with a floor to at least partially close the crane housing at the lower end, the lower end is preferably provided with a circumferential stiffener.

In case the crane housing is not provided with a roof to at least partially close the crane housing at the upper end, the upper end is preferably provided with a circumferential stiffener.

In an embodiment the box element end portions of the box elements of the boom support structure protrude at least in part into the upper section of the circumferential wall, and the lower end of the circumferential wall has a slew bearing flange that is adapted to be mounted to the slew bearing, and the oblique strengthening ribs are mounted onto and integrated with the inside of the circumferential wall and at least some of them are connected to said slew bearing flange, e.g. to the part thereof that protrudes radially inward from the circumferential wall.

In an embodiment the circumferential wall, on the inside and/or the outside thereof, preferably at least on the inside thereof, is provided with at least one circumferential stiffener. Preferably multiple, e.g. two, vertically spaced circumferential stiffeners are provided. The oblique strengthening ribs extending obliquely from the box element end portions each intersect one or more of the circumferential stiffeners and are connected thereto at these intersections.

In an embodiment the boom support structure comprises a transverse beam extending transversely and at a height above the upper end of the wall, wherein said transverse beam is provided with two boom pivot members at a distance from each other in transverse direction, and wherein said transverse beam is supported on these at least two box elements of each of which an end portion overlaps with and is integrated with the upper section of the wall.

In a preferred embodiment, the transverse beam is supported at each transverse end thereof on a pair of box elements, each pair including a front box element and a rear box element, wherein the rear box element is connected to the upper section of the circumferential wall at a location further towards the rear of the crane housing than the front box element.

In a preferred embodiment, the box element end portions of the rear box elements of the boom support structure protrude at least in part into the upper section of the circumferential wall and the lower end of the circumferential wall has a slew bearing flange that is adapted to be mounted to said slew bearing, wherein one or more forward as well as one or more rearward oblique strengthening ribs are mounted onto and integrated with the inside of the circumferential wall and extend from said box element end portions of said rear box elements and are connected to said slew bearing flange.

In a preferred embodiment, the box element end portions of front box elements of the boom support structure protrude at least in part into the upper section of the circumferential wall, and the lower end of the circumferential wall has a slew bearing flange that is adapted to be mounted to the slew bearing, wherein one or more forward oblique strengthening ribs are mounted onto and integrated with the inside of the circumferential wall and extend from these box element end portions of rear box elements and are connected to the slew bearing flange.

In an embodiment the circumferential wall on the inside thereof is provided with a lower and upper circumferential stiffener which are vertically spaced apart. Herein the lower section of the circumferential wall is delimited between the lower end of said wall and the lower circumferential stiffener, and the upper section of the circumferential wall is delimited between the upper circumferential stiffener and the upper end of the wall. A middle section of the circumferential wall is delimited between the lower and upper circumferential stiffeners.

In an embodiment one forward and one rearward of the oblique strengthening ribs that adjoin box element end portions of rear box elements of the boom support structure are each attached to the respective box element end portion substantially at the level of the upper end of the circumferential wall and each extend oblique downwards to the lower end and intersecting lower and upper circumferential stiffeners and connect thereto.

In an embodiment one or more, preferably multiple, slew drive motor carriers are mounted to the lower section of the circumferential wall, e.g. at the inside thereof. Each carrier may comprise an upper and lower slew drive motor carrier plate, e.g. said lower slew drive motor carrier plate being integral with a slew bearing flange of the crane housing.

In an embodiment the crane housing further comprises at a rear side thereof one or more rear gantry attachment structures that are each adapted to connect thereto a rear frame member of a gantry structure of the crane, e.g. said rear frame member being substantially vertical in assembled condition. In an embodiment the one or more rear gantry attachment structures each have a box elements of each of which an end portion overlaps with and is integrated with the upper section of the circumferential wall. In an embodiment, as preferred, the crane housing further comprises oblique strengthening ribs that are mounted onto and integrated with a side of the circumferential wall, each of these oblique strengthening ribs extending from a respective box element end portion in an oblique downwards direction towards the lower end of the wall.

In an embodiment box element end portions of box elements of one or more rear gantry attachment structures protrude at least in part into the upper section of the circumferential wall. In an embodiment the lower end of the circumferential wall has a slew bearing flange that is adapted to be mounted to said slew bearing, and one or more forward as well as one or more rearward oblique strengthening ribs are mounted onto and integrated with the inside of the circumferential wall and extend from these box element end portions of said box elements and are connected to the slew bearing flange.

In an embodiment the boom support structure is also provided with one or more front gantry attachments structures that are adapted to connect to a front frame member of a gantry structure of the crane, e.g. said front frame member being inclined backwards and having a top end that is connected to a substantially vertical rear frame member of the gantry structure. In an embodiment the one or more front gantry attachments structures are mounted on a transverse beam of the boom support structure.

In an embodiment, the circumferential wall is provided with a circumferential stiffener on the inside of the wall and below the upper end of the wall, e.g. a stiffener that is parallel to the upper end of the wall. Preferably each box element end portion protrudes at least in part into the circumferential wall and extends downwards from the upper end of the wall to join to the circumferential stiffener, possibly extending further down below this stiffener, e.g. having vertical ribs to a lower circumferential stiffener.

In an embodiment, at least one of the one or more box elements, preferably all box elements, adjoins an associated oblique strengthening rib which extends from the respective box element at the upper end of the circumferential wall in an oblique downwards direction away from the box element towards the lower end of the wall. Preferably, the associated strengthening rib extends at least between the upper end of the wall and a circumferential stiffener, most preferably down to the level of the floor or to the circumferential slew bearing flange.

It will be apparent that the oblique strengthening ribs and circumferential stiffeners may be arranged on an inner side and/or an external side of the circumferential wall. However, it is preferred that oblique strengthening ribs and circumferential stiffeners are arranged only on the inner side of the circumferential wall.

The crane housing may also comprises vertical stiffeners arranged on the inside or outside of the circumferential wall, e.g. only on the inside, e.g. between the slew bearing flange and one or more circumferential stiffeners spaced above the slew bearing flange.

In an embodiment, the circumferential wall comprises a middle section in between the lower section and the upper section, which middle section is delimited by two circumferential stiffeners arranged on the wall e.g. parallel to the lower end of the wall. It is also possible that a plurality of middle sections are provided between the lower section and the upper section, wherein between adjacent sections a corresponding circumferential stiffener is provided that is arranged on the wall, e.g. parallel to the lower end of the wall.

By providing one or more circumferential stiffeners, additional strength is introduced to the wall allowing the wall to substantially maintain its circular shape despite the loads applied to it.

In an embodiment, one or more box element end portions extend at least in part within the circumferential wall and down from the upper end of the circumferential wall, wherein one or more circumferential stiffeners arranged on the inside of the circumferential wall intersect the inward part of the box element end portion and are connected thereto at intersections, and wherein an oblique strengthening rib extends from such intersection in an oblique downwards direction away from intersection towards the lower end, preferably to the floor or to the slew bearing flange at the lower end of the wall.

In an embodiment, oblique strengthening ribs may extend on both sides of a box element or only on one side, depending on how the loads need to be distributed.

In an embodiment, front box elements of the boom support structure only have associated sets of oblique strengthening ribs extending forward and towards each other, and rear box elements of the boom support structure have associated sets of strengthening ribs extending forward and rearward, so in diverging directions relative to the rear box elements.

In an embodiment, the gantry attachment structure comprises two box elements connected to the upper section of the wall at the rear side of the crane housing. In other words, the gantry attachment structure forms two support locations for supporting the gantry structure, wherein each support location comprises a single associated box element. Preferably, these two box elements each have associated oblique strengthening ribs extending forward and rearward of the box elements.

In an embodiment, the gantry structure is supported both by the boom support structure and by a one or more rear gantry attachment structures fitted at the rear of the crane housing.

In an embodiment the boom support structure has pivot brackets that define a horizontal pivot axis for a front frame member of the gantry structure.

In an embodiment the rear gantry attachment structures have pivot bracket that define a horizontal pivot axis for a rear frame member of the gantry structure.

In an embodiment the gantry structure has a substantially vertical rear frame member and an inclined front frame member, that are releasably connected at a top and that each have a lower end pivotally connected to the crane housing about a horizontal pivot axis, e.g. allowing to disconnect said frame members at the top and folding down each of said frame members about its respective pivot axis, e.g. so allowing to reduce crane height for passing a bridge.

The invention also relates to a crane comprising:

- a fixed base structure;
- a crane housing as described herein;
- a slew bearing, e.g. a roller slew bearing as described herein, arranged in between the lower end of the circumferential wall of the crane housing and fixed base structure to allow rotation of the crane housing relative to the base structure about a substantially vertical rotation axis;
- a pivotal boom that is pivotally supported by the boom support structure at a front side of the crane housing and pivotal about a horizontal pivot axis; and
- a gantry structure supported by the crane housing,
- a luffing cable and winch system comprising a luffing cable extending between the gantry structure and the boom adapted to pivot the boom up and down by means of a luffing winch and orient the boom in one or more desired angles during lifting of a load.

In an embodiment, a front frame member of the gantry structure is supported by the boom support structure.

In an embodiment the boom support structure defines a horizontal pivot axis for a front frame member of the gantry structure.

In an embodiment the crane housing is provided at the rear thereof with one or more rear the gantry attachment structures, e.g. embodied to define a horizontal pivot axis for a rear frame member of the gantry structure.

In an embodiment, the crane further comprises one or more winches, e.g. luffing winches, and one or more associated cables, e.g. luffing cables, to be driven by the one or more winches, wherein the one or more winches are supported by the crane housing outside of the rear side thereof. As a result thereof, the one or more winches can function as ballast weight for the crane.

The invention further relates to a vessel comprising a crane according to the invention, wherein the fixed base structure is mounted to a hull of the vessel.

According to a further aspect of the invention, there is provided a crane housing comprising:

a substantially cylinder-shaped circumferential wall with a lower section delimited by a lower end of the wall to be connected to a slew bearing, and an upper section delimited by an upper end of the wall; and a boom support structure connected to the upper section of the wall for supporting a boom of the crane at a front side of the crane housing, wherein the boom support structure is connected to the upper section of the wall via one or more box elements that have an end portion that is integral with the wall, and wherein the crane housing further comprises strengthening ribs arranged on the wall extending from the one or more box elements in an oblique downwards direction away from the one or more box elements towards the lower end of the wall in order to distribute loads introduced by the boom support structure over the lower end of the wall.

According to a further aspect of the invention, there is provided a crane housing comprising:

a substantially cylinder-shaped circumferential wall with a lower section delimited by a lower end of the wall, which lower end is adapted to be mounted to a slew bearing (SB), said lower end having a diameter corresponding substantially to the diameter of the slew bearing (SB), and with an upper section delimited by an upper end of the wall, the wall having an inside and an outside, a boom support structure adapted to support an inner end of a pivotal boom of the crane to pivot about a horizontal pivot axis, which boom support structure is arranged at a front side of the crane housing, wherein the crane housing further comprises at a rear side thereof one or more rear gantry attachment structures adapted to connect thereto a rear frame member of a gantry structure of the crane, wherein said one or more rear gantry attachment structures each have a box elements of each of which an end portion overlaps with and is integrated with the upper section of the wall, and wherein the crane housing further comprises oblique strengthening ribs that are mounted onto and integrated with a side of the circumferential wall, each of said oblique strengthening ribs extending from a respective box element end portion in an oblique downwards direction towards the lower end of the wall.

In an embodiment said box element end portions of said box elements of said one or more rear gantry attachment structures protrude at least in part into the upper section of the circumferential wall, and said lower end of the circumferential wall has a slew bearing flange that is adapted to be mounted to said slew bearing, wherein one or more forward as well as one or more rearward oblique strengthening ribs are mounted onto and integrated with the inside of the circumferential wall and extend from said box element end portions of said box elements and are connected to said slew bearing flange.

In an embodiment the boom support structure is provided with one or more front gantry attachments structures adapted to connect to a front frame member of a gantry structure of the crane, e.g. in an embodiment said one or more front gantry attachments structures being mounted on a transverse beam of the boom support structure.

In yet another aspect of the invention, there is provided a crane comprising a crane housing and a gantry structure mounted on said crane housing, wherein said crane housing comprises:

a circumferential wall with a lower section delimited by a lower end of the wall, which lower end is adapted to be mounted to a slew bearing, said lower end having a diameter corresponding substantially to the diameter of the slew bearing, and with an upper section delimited by an upper end of the wall, the wall having an inside and an outside, a boom support structure adapted to support an inner end of a pivotal boom of the crane to pivot about a horizontal pivot axis, which boom support structure is arranged at a front side of the crane housing, wherein one or more front gantry attachment structures are provided that are adapted to connect to a front frame member of a gantry structure of the crane, e.g. said boom support structure being provided with said one or more front gantry attachment structures, and wherein the crane housing further comprises at a rear side thereof one or more rear gantry attachment structures adapted to connect thereto a rear frame member of a gantry structure of the crane, and wherein the rear frame member and front frame member of the gantry structure are releasably connected at a top, and wherein said front and rear gantry attachment structures are each embodied to provide a horizontal axis pivot connection for the respective frame member of the gantry structure allowing to disconnect said gantry structure frame members at the top and folding down each of said frame members about its respective pivot axis, e.g. so allowing to reduce crane height for passing a bridge with a vessel provided with the crane.

This method also relates to a method for folding down the gantry structure of the crane.

The further aspects of the invention also relates to a crane comprising such a crane housing and a vessel comprising such a crane.

It will be apparent that features and embodiments described above for one aspect of the invention may also apply to any other aspect of the invention where appropriate.

The invention will now be described in more detail in a non-limiting way by reference to the accompanying drawings in which like parts are indicated by like reference symbols, and in which.

Figure 1:
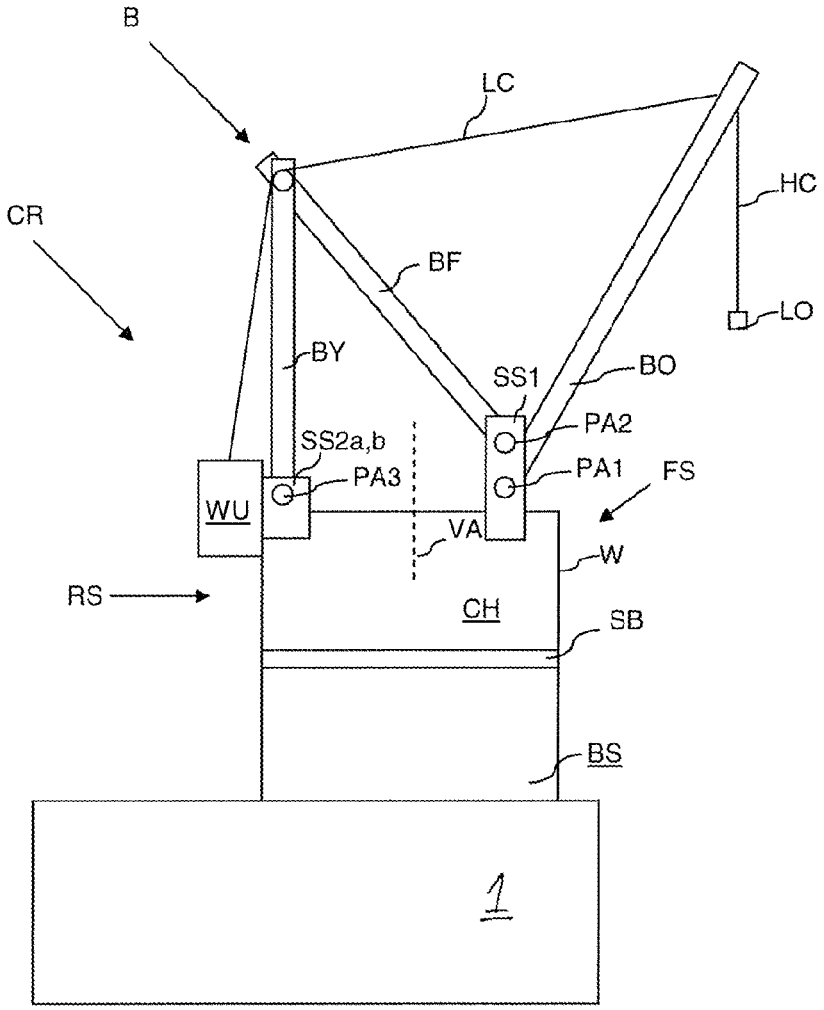
FIG. 1 depicts schematically a vessel provided with a crane according to an embodiment of the invention.

FIG. 1 very schematically depicts a vessel having a hull 1, e.g. a semi-submersible crane vessel with a deck structure 1, on which a crane CR according to an embodiment of the invention is mounted. It will be appreciated that the crane is of the same type as disclosed in WO2015/088332.

The crane CR is a so-called slewing crane comprising a fixed base structure BS, here a crane tub mounted to the deck structure 1. The crane CR can also be connected to the earth for onshore operations.

The crane CR comprises a crane housing CH, which will be explained below in more detail.

A slew bearing SB is arranged in between the crane housing CH and the fixed base structure BS to allow slewing of the crane housing CH relative to the base structure BS about a substantially vertical slewing axis VA. As preferred the slew bearing is a roller slew bearing comprising raceways and a multitude of rollers arranged between said raceways and embodied to absorb vertical loads, radial loads, as well as tilting loads. An example of such a roller slew bearing is presented in WO2015/088332.

The crane housing CH comprises a substantially cylinder-shaped circumferential wall W that is preferably made of steel.

A boom support structure SS1 is connected to an upper section of the wall W for supporting a boom, or main boom, BO of the crane CR at a front side FS of the crane housing CH.

One or more rear gantry attachment structures SS2*a, b* are connected to the upper section of the wall W for supporting a gantry structure B of the crane CR at a rear side RS of the crane housing CH.

The boom support structure SS1 defines a first horizontal pivot axis PA1 for the boom BO to allow the boom BO to be pivoted up and down.

In this embodiment, the gantry structure B comprises an inclined front frame member BF supported at its lower end by the boom support structure SS1, and a vertical rear frame member, or back stay member, BY supported by the rear gantry attachment structures SS2*a,b*. In assembled state the front frame member BF and the rear frame member BY are releasably connected to each other at the top to form gantry structure B.

The boom support structure SS1 defines a second horizontal pivot axis PA2 for the front frame BF and the rear gantry attachment structures SS2*a, b* define a third horizontal pivot axis PA3 for the rear frame member BY. This allows to pivot the disconnected frame members of the gantry structure up and down when the frame members are disconnected from each other at the top, e.g. to pass a bridge or for maintenance/assembly purposes.

At the rear side RS, outside of the circumferential wall W, a winch unit WU is carrier by the crane housing. This unit comprises one or more winches, in this example at least two winches. At least one winch is a luffing winch that is operable to set the vertical angle of the boom BO using one or more luffing cables LC extending between the top of the gantry structure B and outer end of the boom BO. At least one other winch may be operable to haul in or pay out a hoisting cable HC to lift or lower a load (not shown) using a load connector LO, e.g. a hook.

An advantage of arranging the winch unit WU at the rear side RS of the crane housing CH is that the winch unit WU can also be used as a ballast, and that the winches and thus the cables are all provided on the same rotatable portion of the crane CR, i.e. the crane housing CH.

It is noted that not all winches need to be located at the rear side of the crane housing CH. For instance, the winches used to hoist a load may be located elsewhere, e.g. within the crane housing, on the boom, etc.

Figure 2:
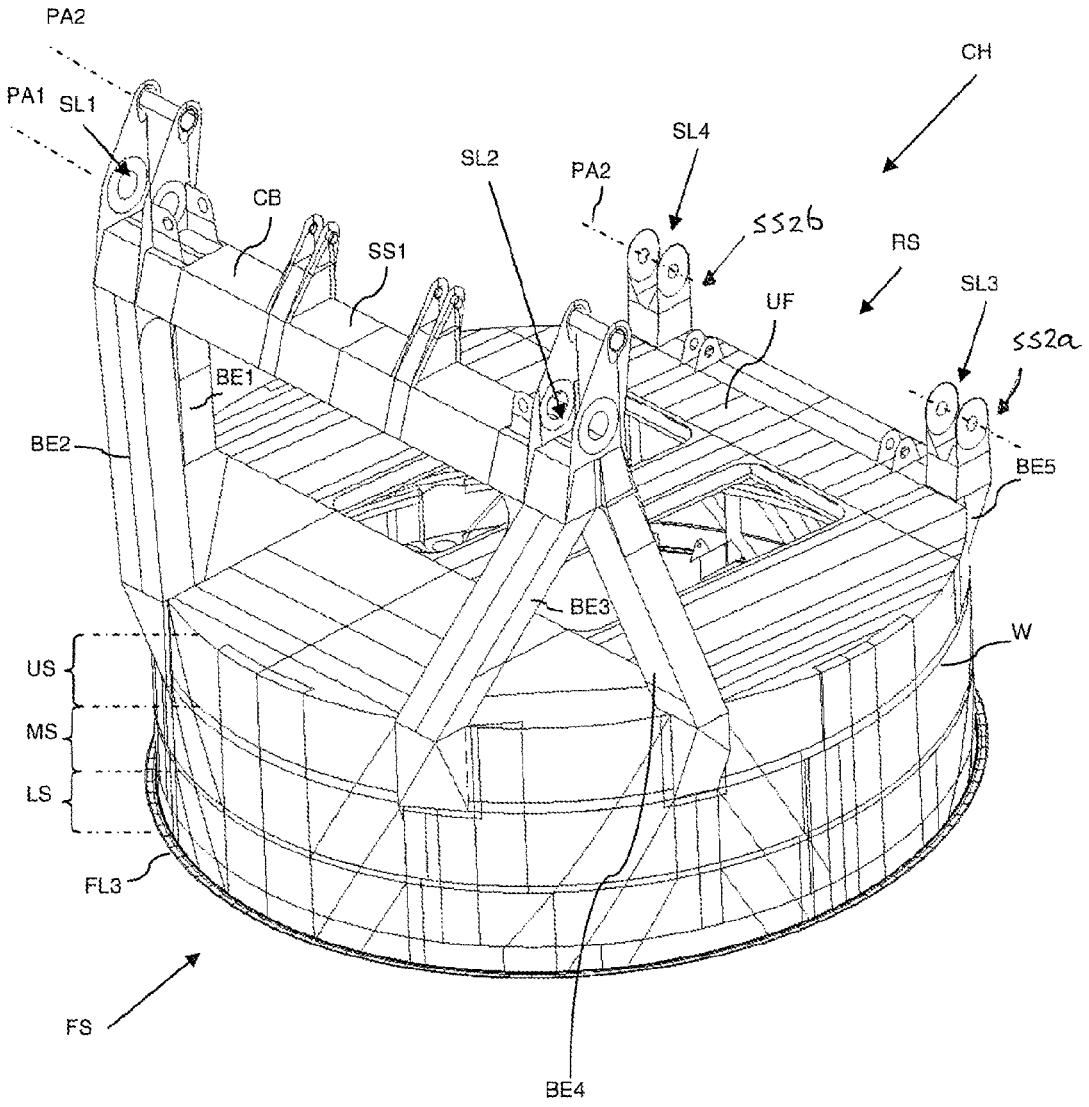
FIG. 2 depicts a model of a crane housing according to another embodiment of the invention.
Figure 3:
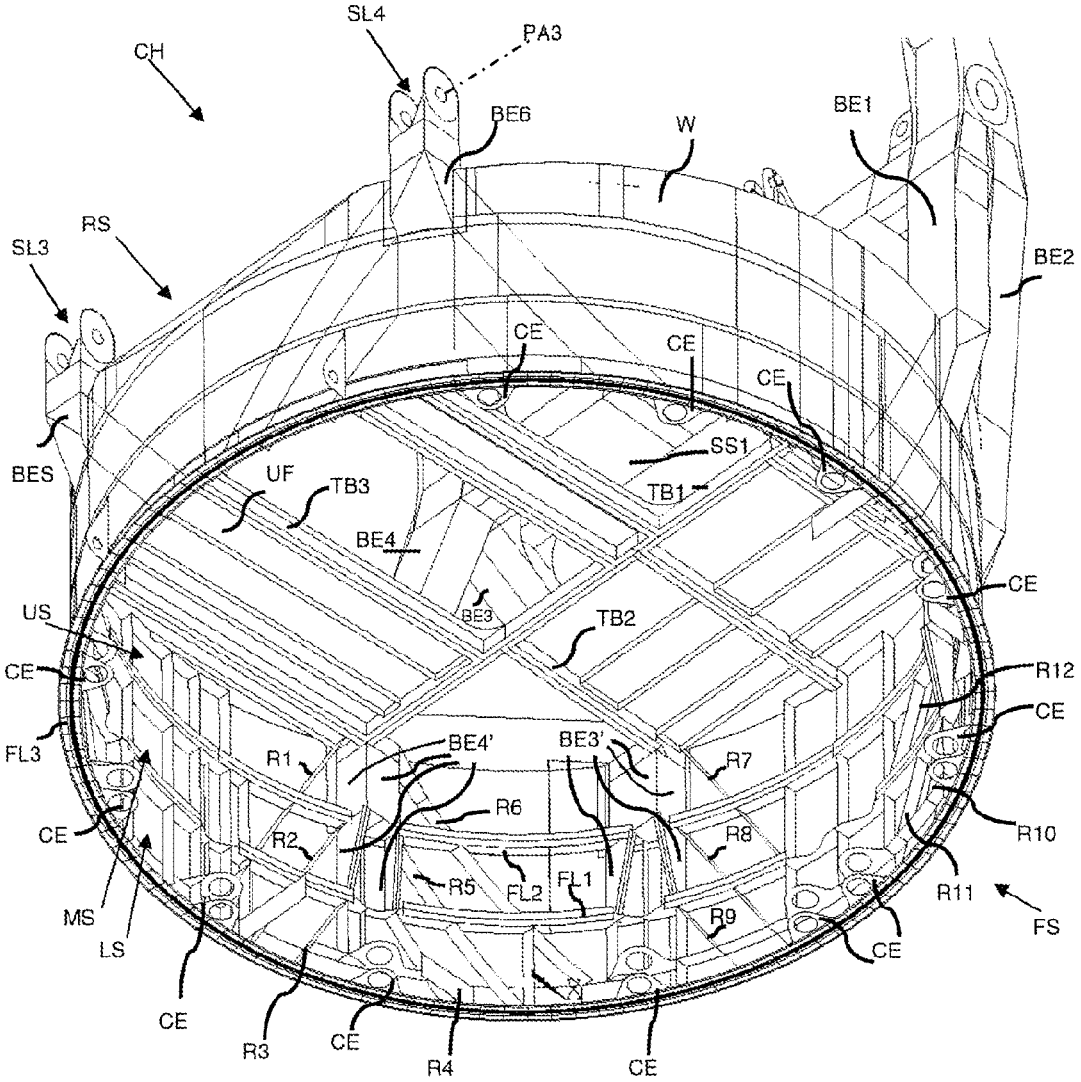
FIG. 3 depicts the interior of the crane housing of FIG. 2 from below.
Figure 4:
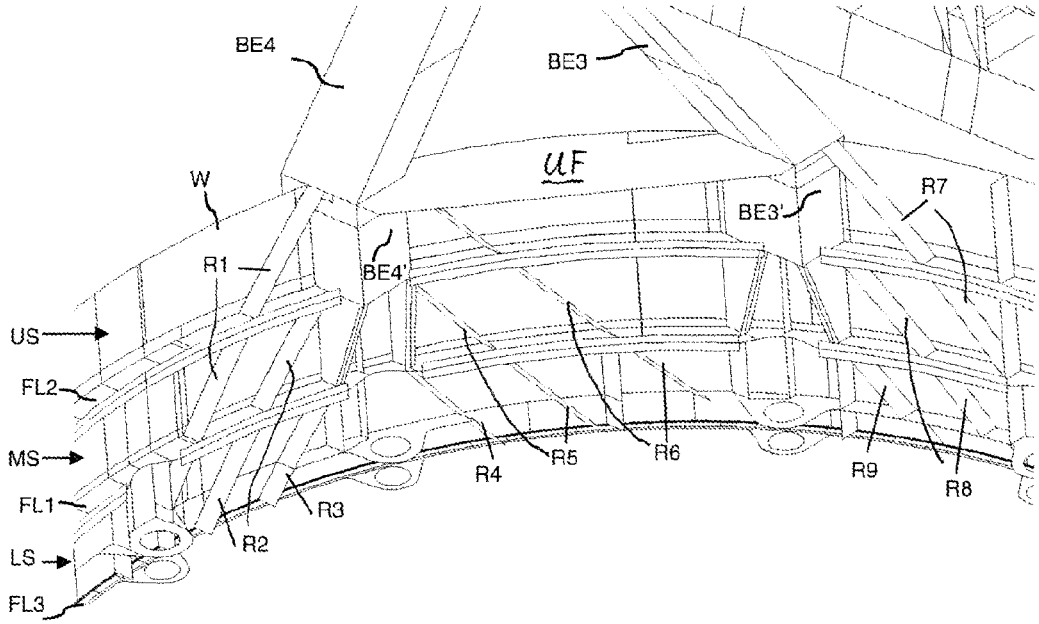
FIG. 4 depicts a part of the crane housing of FIG. 2.
Figure 5:
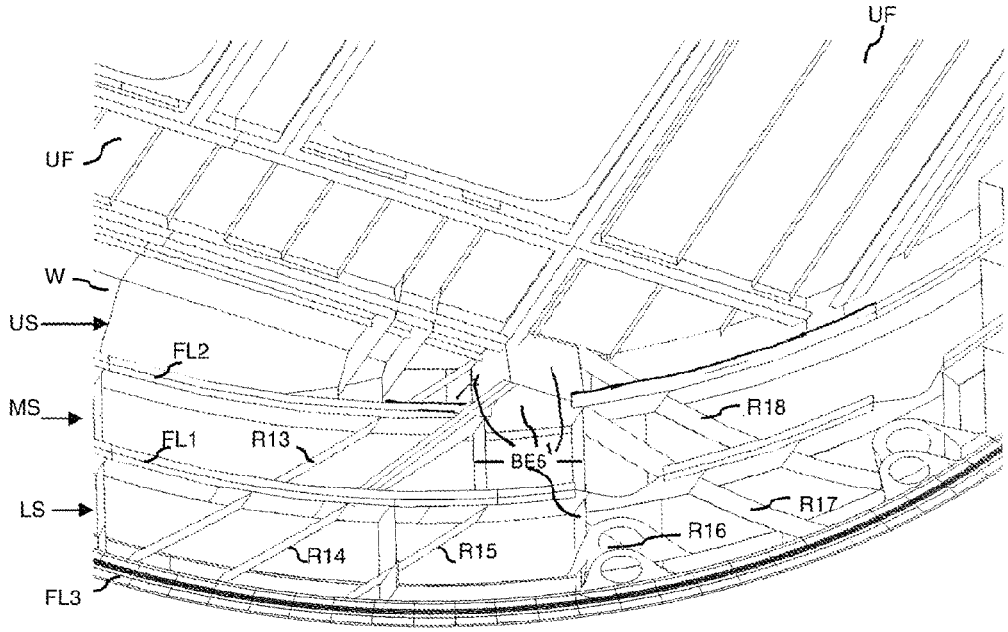
FIG. 5 depicts another part of the crane housing of FIG. 2.

FIGS. 2-5 depict in more detail a model of a crane housing CH according to the invention. FIG. 2 depicts a perspective view and FIG. 3 depicts the interior of the crane housing with the floor of the crane housing omitted to show the interior. FIGS. 4 and 5 depict detailed views of two areas of the crane housing with the floor omitted and in FIG. 4 with part of the roof omitted.

The crane housing CH comprises a substantially cylinder-shaped circumferential wall W made of steel with a lower section LS, an upper section US and a middle section MS in between the lower section LS and the upper section US. As will be appreciated these sections are integrated into one continuous wall W and primarily serve to better understand the invention.

The middle section MS is delimited by two circumferential stiffeners FL1, FL2 that are vertically spaced apart, and spaced from the neighbouring lower end and upper end of the wall respectively. As preferred the stiffeners FL1, FL2 are arranged on the inside of the wall W. The circumferential stiffeners provide stiffness to the wall W, distribute loads as they adjoin the box element end portions as well as oblique strengthening ribs, and assist to maintain the circular shape of the structure during operation.

The lower section LS is delimited by the circumferential stiffener FL1 and a slew bearing flange FL3 at a lower end of the wall W.

The slew bearing flange FL3 is embodied to connect the lower end of the wall W to a slew roller bearing of substantially the same diameter (not shown here, see WO2015/088233 for an example). For example the diameter is 15 meters or more, in the depicted embodiment the diameter is about 30 meters and components are shown substantially to scale in FIGS. 2-5.

The upper section US is delimited by the circumferential stiffener FL2 and the upper end of the wall W, where a roof UF adjoins the upper end of the wall W and partially closes off a top of the cylinder-shaped wall W.

Although not shown, the crane housing is preferably provided with a floor that at least partially closes off a bottom of the cylinder-shaped wall W. This floor can then be used to support further equipment, e.g. electronic equipment and/or winches, and/or slew drive motors, of the crane inside the crane housing.

The crane housing CH further comprises a boom support structure SS1 connected to the upper section US of the wall W, here via two pairs of box elements BE1, BE2, BE3, BE4 that each have an end portion that overlaps with and is integral with the wall W, at least the upper section thereof.

The boom support structure SS1 provides two pivot brackets SL1, SL2 adapted to support a boom (not shown here, see FIG. 1 for an example), such that the boom can pivot about a pivot axis PA1. The two pivot bracket SL1, SL2 are mounted spaced apart in transverse direction on a transverse beam CB that is at either end thereof supported on a pair of the box elements BE1, BE2, BE3, BE4.

Bracket SL1 is mainly supported by box elements BE1 and BE2, wherein box element BE2 is a front box element supporting the bracket SL1 at a front side FS of the crane housing CH, and wherein box element BE1 is a rear box element connected to the upper section US of the wall W at a distance from the front box element BE2 towards a rear side RS of the crane housing CH.

Bracket SL2 is mainly supported by box elements BE3 and BE4, wherein box element BE3 is a front box element supporting the bracket SL2 at the front side FS of the crane housing CH, and wherein box element BE4 is a rear box element connected to the upper section US of the wall W at a distance from the front box element BE3 towards the rear side RS of the crane housing CH.

The two brackets SL1, SL2 further define support and attachment member, here also a second pivot axis PA2, for a front frame member FB of the gantry structure (not shown here, see FIG. 1 for an example) to allow the frame member to be pivoted up and down, e.g. when passing a bridge.

The crane housing CH further comprises rear gantry attachment structures SS2*a, b* that are each connected at the rear of the housing to the upper section US of the wall W via two box elements BE5, BE6 of which an end portion of each overlaps with and is integral with the wall W.

The rear gantry attachment structures SS2*a, b* provides two support brackets SL3, SL4 for supporting a back frame member, or back stay member, of the gantry structure (not shown here, see FIG. 1 for an example). Here, the two support brackets define a third pivot axis PA3, such that the back frame member BY can be pivoted up and down, e.g. when passing a bridge.

As clearly depicted in FIG. 3 for end portions of the box elements BE3 and BE4, but applicable to all box elements BE1-BE6, extend in part into or within at least the upper section US of the circumferential wall W and even further down. The end portions of the box elements are indicated in FIGS. 3 and 4 by reference symbols BE3' and BE4', and in FIG. 5 by reference symbol BE5', respectively.

On the inside of the wall W are provided multiple oblique strengthening ribs in order to distribute loads introduced via the box elements.

A shown box element end portions of box elements BE1, BE2, BE3, BE4 protrude at least in part into the upper section of the circumferential wall W.

Oblique strengthening ribs R1-R9 are mounted onto and integrated with the inside of the circumferential wall W. Ribs R2, R3, R4, R5 extend all the way to the slew bearing flange FL3 and are connected thereto.

In FIGS. 3 and 4, oblique strengthening ribs R1-R12 associated with box elements BE2, BE3 and BE4 are clearly visible and in FIG. 5, oblique strengthening ribs R13-R18 associated with box element BE5 are shown. The extension of ribs is also illustrated in FIG. 2. These ribs are, as preferred, however arranged on the inside of the wall and not on the outside thereof.

It is noted here that the depicted crane housing has a symmetrical design, i.e. the left side of the crane housing is substantially a mirror image of the right side of the crane housing. In other words, the crane housing is symmetrical with respect to a vertical plane extending through the centre of the crane housing perpendicular to the first, second and third pivot axes PA1, PA2, PA3. Hence, all mentioned strengthening ribs have a corresponding strengthening rib associated with one of the other box elements BE1, BE2 and BE6.

All strengthening ribs extend from a respective box element end portion in an oblique downwards direction away from the respective box element end portion towards a lower end of the wall W, some all the way to the slew bearing flange FL3 and connected thereto.

In this embodiment, strengthening ribs R1, R5, R7, R12, R13 and R18 extend from the respective box elements at the upper end of the wall, strengthening ribs R2, R5, R8, R11, R14 and R17 extend from the respective box elements at the circumferential stiffener FL2 between the upper section US and the middle section MS, and strengthening ribs R3, R4, R9, R10, R15 and R16 extend from the respective box elements at the circumferential stiffener FL1 between the middle section MS and the lower section LS.

Further, for this embodiment, the strengthening ribs R1, R2 and R3 associated with box element BE4 extend rearward towards the rear side RS of the crane housing, while the strengthening ribs R4, R5, R6 extend forward towards the front side FS of the crane housing CH. The strengthening ribs R7-R12 associated with the box elements BE2 and BE3 extend forward and towards each other, and in this embodiment, there are no strengthening ribs associated with these box elements BE2, BE3 that extend rearward towards the rear side of the crane housing.

The circumferential wall on the inside thereof has two vertically spaced circumferential stiffeners FL1, FL2, and oblique strengthening ribs R1-R9 each intersect one or both circumferential stiffeners and are connected thereto at the one or more intersections.

The box element end portions of the rear box elements BE1, BE4 of the boom support structure SS1 protrude at least in part into the upper section of the circumferential wall W. One or more forward as well as one or more rearward oblique strengthening ribs R2-R5 are mounted onto and integrated with the inside of the circumferential wall W and extend from these box element end portions of said rear box elements BE1, BE4 and are connected to slew bearing flange FL3.

The roof UF comprises beams extending between box elements to provide further stiffness to the crane housing. Examples thereof in FIG. 3 are transverse beam TB1 extending between box elements B1 and B4, and beams TB2 and TB3 extending between transverse beam TB1 and box elements BE3 and BE5, respectively.

Also shown in FIGS. 3, 4, 5 are slew drive motor carriers CE which are mounted to the lower section of the circumferential wall W. In the depicted embodiment each carrier CE comprises an upper and lower slew drive motor carrier plate, and the lower slew drive motor carrier plate is integral with slew bearing flange FL3 of the crane housing. As will be understood the slew drive motors allow to slew the crane housing CH relative to the base structure.

The invention claimed is:

1. A crane housing comprising:

a substantially cylinder-shaped circumferential wall with a lower section delimited by a lower end of the wall, the lower end being adapted to be mounted to a slew bearing, said lower end having a diameter corresponding substantially to the diameter of the slew bearing, and with an upper section delimited by an upper end of the wall, the wall having an inside and an outside; and a boom support structure adapted to support an inner end of a pivotal boom of the crane to pivot about a horizontal pivot axis, the boom support structure being arranged at a front side of the crane housing, wherein the boom support structure comprises at least two box elements, each of the at least two box elements having an end portion overlapping with and integrated with the upper section of the wall, and wherein the crane housing further comprises oblique strengthening ribs that are mounted onto and integrated with a side of the circumferential wall, each of said oblique strengthening ribs extending from a respective box element end portion in an oblique downwards direction towards the lower end of the wall.

2. The crane housing according to claim 1, wherein said box element end portions of said box elements of said boom support structure protrude at least in part into the upper section of the circumferential wall, and wherein said lower end of the circumferential wall has a slew bearing flange that is adapted to be mounted to said slew bearing, and wherein said oblique strengthening ribs are mounted onto and integrated with the inside of the circumferential wall and are connected to said slew bearing flange.

3. The crane housing according to claim 1, wherein the circumferential wall on the inside and/or the outside thereof is provided with at least one circumferential stiffener, and wherein said oblique strengthening ribs each intersect said one or more circumferential stiffeners and are connected thereto at said intersections.

4. The crane housing according to claim 1, wherein the boom support structure comprises a transverse beam extending transversely and at a height above the upper end of the wall, wherein said transverse beam is provided with two boom pivot members at a distance from each other in transverse direction, and wherein said transverse beam is supported on said at least two box elements, each of said at least two box elements having an end portion overlapping with and integrated with the upper section of the wall.

5. The crane housing according to claim 4, wherein said transverse beam is supported at each transverse end thereof on a pair of box elements, each pair including a front box element and a rear box element, wherein the rear box element is connected to the upper section of the circumferential wall at a location further towards the rear of the crane housing than the front box element.

6. The crane according to claim 5, wherein said box element end portions of said rear box elements of said boom support structure protrude at least in part into the upper section of the circumferential wall, and wherein said lower end of the circumferential wall has a slew bearing flange that is adapted to be mounted to said slew bearing, and wherein one or more forward as well as one or more rearward oblique strengthening ribs are mounted onto and integrated with the inside of the circumferential wall and extend from said box element end portions of said rear box elements and are connected to said slew bearing flange.

7. The crane housing according to claim 6, wherein the circumferential wall on the inside thereof is provided with a lower and upper circumferential stiffener which are vertically spaced apart, wherein the lower section of the circumferential wall is delimited between the lower end of said wall and the lower circumferential stiffener, and wherein the upper section of the circumferential wall is delimited between the upper circumferential stiffener and the upper end of the wall, and wherein a middle section of the circumferential wall is delimited between said lower and upper circumferential stiffener, and wherein one forward and one rearward of said oblique strengthening ribs adjoining said box element end portions of said rear box elements of said boom support structure each attach to said box element end portion substantially at the level of the upper end of the circumferential wall and each extends oblique downwards to the lower end intersecting said lower and upper circumferential stiffeners and connecting thereto.

8. The crane housing according to claim 5, wherein said box element end portions of said front box elements of said boom support structure protrude at least in part into the upper section of the circumferential wall, and wherein said lower end of the circumferential wall has a slew bearing flange that is adapted to be mounted to said slew bearing, and wherein one or more forward oblique strengthening ribs are mounted onto and integrated with the inside of the circumferential wall and extend from said box element end portions of said rear box elements and are connected to said slew bearing flange.

9. The crane housing according to claim 1, wherein the circumferential wall on the inside thereof is provided with a lower and upper circumferential stiffener which are vertically spaced apart, wherein the lower section of the circumferential wall is delimited between the lower end of said wall and the lower circumferential stiffener, and wherein the upper section of the circumferential wall is delimited between the upper circumferential stiffener and the upper end of the wall, and wherein a middle section of the circumferential wall is delimited between said lower and upper circumferential stiffener.

10. The crane housing according to claim 1, wherein one or more slew drive motor carriers are mounted to the lower section of the circumferential wall.

11. The crane housing according to claim 1, wherein the crane housing further comprises at a rear side thereof one or more rear gantry attachment structures adapted to connect thereto a rear frame member of a gantry structure of the crane, wherein said one or more rear gantry attachment structures each have a box elements of each of which an end portion overlaps with and is integrated with the upper section of the wall, and wherein the crane housing further comprises oblique strengthening ribs that are mounted onto and integrated with a side of the circumferential wall, each of said oblique strengthening ribs extending from a respective box element end portion in an oblique downwards direction towards the lower end of the wall.

12. The crane housing according to claim 11, wherein said box element end portions of said box elements of said one or more rear gantry attachment structures protrude at least in part into the upper section of the circumferential wall, and wherein said lower end of the circumferential wall has a slew bearing flange that is adapted to be mounted to said slew bearing, and wherein one or more forward as well as one or more rearward oblique strengthening ribs are mounted onto and integrated with the inside of the circumferential wall and extend from said box element end portions of said box elements and are connected to said slew bearing flange.

13. The crane housing according to claim 1, wherein the boom support structure is provided with one or more front gantry attachments structures adapted to connect to a front frame member of a gantry structure of the crane.

14. The crane housing according to claim 1, wherein the crane housing is at least partially closed at the lower end of the wall by a floor.

15. The crane housing according to claim 1, wherein the crane housing is at least partially closed at the upper end of the wall by a roof.

16. A crane comprising:

a fixed base structure;

the crane housing according to claim 1;

a slew bearing arranged in between the lower end of the circumferential wall of the crane housing and fixed base structure to allow rotation of the crane housing relative to the base structure about a substantially vertical rotation axis;

a pivotal boom that is pivotally supported by the boom support structure at a front side of the crane housing and pivotal about a horizontal pivot axis;

a gantry structure supported by the crane housing; and a luffing cable and winch system comprising a luffing cable extending between said gantry structure and the boom adapted to pivot the boom up and down by a luffing winch and orient the boom in one or more desired angles during lifting of a load.

17. A vessel comprising a crane according to claim 16, wherein the fixed base structure is mounted on or to a hull of the vessel.

18. The vessel according to claim 17, wherein the fixed base structure is embodied as a tub structure extending above a deck of the vessel.

* * * * *